US008733761B2

(12) United States Patent
Glover

(10) Patent No.: US 8,733,761 B2
(45) Date of Patent: May 27, 2014

(54) GENETIC DECK BASED GAME METHOD OF PLAY

(71) Applicant: Eric R. Glover, Chicago, IL (US)

(72) Inventor: Eric R. Glover, Chicago, IL (US)

( * ) Notice: Subject to any disclaimer, the term of this patent is extended or adjusted under 35 U.S.C. 154(b) by 0 days.

(21) Appl. No.: 13/725,042

(22) Filed: Dec. 21, 2012

(65) Prior Publication Data

US 2013/0161909 A1 Jun. 27, 2013

Related U.S. Application Data

(60) Provisional application No. 61/579,606, filed on Dec. 22, 2011.

(51) Int. Cl.
*A63F 1/00* (2006.01)
*A63F 3/00* (2006.01)

(52) U.S. Cl.
USPC ..... 273/308; 273/292; 273/303; 273/262

(58) Field of Classification Search
USPC ..... 273/292, 303, 308, 243, 242, 262
See application file for complete search history.

(56) References Cited

U.S. PATENT DOCUMENTS

| | | | | |
|---|---|---|---|---|
| 5,662,332 | A * | 9/1997 | Garfield | 273/308 |
| 5,954,332 | A * | 9/1999 | Mero et al. | 273/236 |
| 2002/0147039 | A1* | 10/2002 | Mahar et al. | 463/11 |
| 2003/0094759 | A1* | 5/2003 | Niedner et al. | 273/255 |
| 2007/0057459 | A1* | 3/2007 | Silva | 273/255 |
| 2007/0265048 | A1* | 11/2007 | Winsick | 463/9 |
| 2008/0036150 | A1* | 2/2008 | Tucker et al. | 273/292 |
| 2009/0051114 | A1* | 2/2009 | Robbers et al. | 273/293 |

* cited by examiner

*Primary Examiner* — Benjamin Layno
(74) *Attorney, Agent, or Firm* — Superior IP, PLLC; Dustin L. Call

(57) ABSTRACT

A game element for use in a genetic deck based game. The game element includes indicia to partition a larger set of game elements into ordered subsets of game elements. The game element also includes a unique identifier for the genetic deck.

15 Claims, 7 Drawing Sheets

GENETIC DECK BASED GAME METHOD OF PLAY

CROSS-REFERENCE TO RELATED APPLICATIONS

This application claims the benefit of and priority to U.S. Provisional Patent Application Ser. No. 61/579,606 filed on Dec. 22, 2011, which application is incorporated herein by reference in its entirety.

BACKGROUND OF THE INVENTION

The present invention which will be described shifts the focus from a plurality of cards to a plurality of decks of cards. This move eliminates the disadvantages of prior art that relies on libraries of cards to build decks. In prior systems there must be special game rules for including multiple copies of the same card within a set, while the present invention eliminates the need for such rules.

The deck based nature of the present invention allows game designers to place limits on the effective power of potential game decks at the time of creation or printing while allowing players to construct a set of components in a manner that is transparent to the player. To attain both of these foregoing advantages, the present invention uses a system of indicia that partition all potential game elements into fixed length decks.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a game element for use in a genetic deck based game. The game element includes indicia to partition a larger set of game elements into ordered subsets of game elements. The game element also includes a unique identifier for the genetic deck.

Another example embodiment includes a system for playing a genetic deck based game. The system includes at least one game element. The at least one game element includes one or more indicia to partition a larger set of game elements into ordered subsets of game elements. The at least one game element also includes a unique identifier for the genetic deck. The system also includes a set of game tokens assigned a numerical value. The system further includes a game surface including a plurality of game spaces.

Another example embodiment includes a system for playing a genetic deck based game. The system includes a game surface including a plurality of game spaces configured to allow play by at least two players. The system also includes a first set of game elements assigned to the first player. Each of the game elements in the first set of game elements includes one or more indicia to partition a larger set of game elements into ordered subsets of game elements and a unique identifier for the first set of game elements. The system further includes a first set of game tokens assigned to the first player, wherein each of the game tokens in the first set of game tokens is assigned a numerical value. The system additionally includes a second set of game elements assigned to the second player. Each of the game elements in the second set of game elements includes one or more indicia to partition a larger set of game elements into ordered subsets of game elements and a unique identifier for the second set of game elements. The system moreover includes a second set of game tokens assigned to the second player, wherein each of the game tokens in the second set of game tokens is assigned a numerical value. The system also includes a layout for each of the two players for placement of the player's game elements. The system further includes a set of random number generators.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1B:
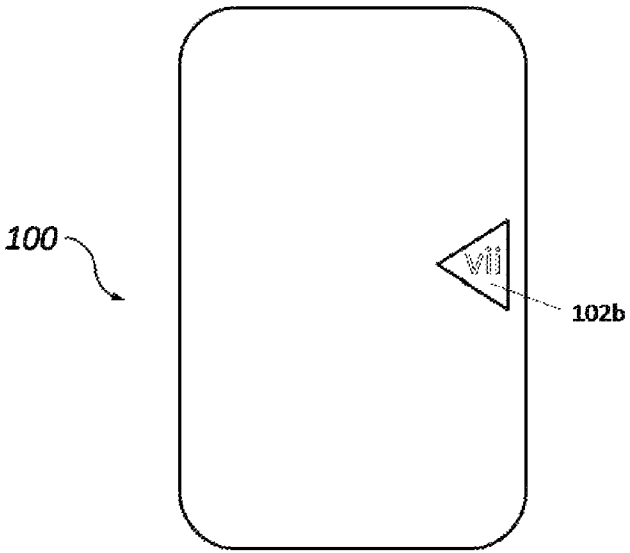
FIG. 1B illustrates a rear view of the example of a game element.
Figure 1A:
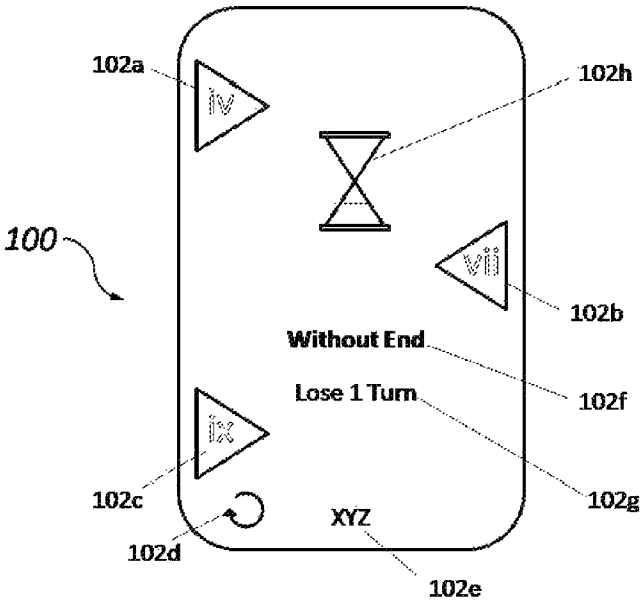
FIG. 1A illustrates a front view of the example of a game element.

FIGS. 1A and 1B illustrate an example of a game element 100. FIG. 1A illustrates a front view of the example of a game element 100; and FIG. 1B illustrates a rear view of the example of a game element 100. The game element 100 can be used to play a genetic deck based game, as described below. The game element 100 can include a card, a virtual representation or any other desired element. The term "genetic deck" is used to describe a plurality of game elements 100 of the type described in the disclosure of this invention that have non-repeating sequence indicia. A "genetic deck" belonging to a player may also be referred to in this disclosure simply as a "deck".

FIGS. 1A and 1B show that the game element 100 can include a set of indicia 102. The indicia can include text recognizable by a human or elements intended to be read by a machine, such as a bar code. The indicia 102 are used to implement a selection right method for the winner of the game. This selection right means that the winner may choose to evolve their deck via a crossover method, to dispatch or to receive modification to their genetic deck by an external factor via a mutation method, or to cause the termination of another player's deck via an extinction method. This selection right method also includes the player's ability to do nothing.

The genetic deck based selection rights sub methods include:

- A mutation method. In "mutation" the "decks" or collection of game elements 100 of one or more players may be modified at one or more contiguous sequence indicia and occurs during interaction with a game journal or database.
  - A point mutation sub method. In a "point mutation" a card of a single sequence indicia is exchanged for another rare card from a pool of game elements 100 that may be outside the set of game elements 100 held in the decks of the players. A mutation is the result of the predetermined interaction of two or more decks based on the deck's deck identifier;
  - A forced mutation sub method. A "forced mutation" causes a player to accept a change regardless of his choice; and
  - A mass mutation sub method. A "mass mutation" can create a new signature indicia, constructing a new signature partition or set of game elements 100 for distribution;
- A crossover method. In "crossover" the decks of both players are modified at one or more contiguous sequence indicia.
  - A point crossover sub method. In a "point crossover" a game element 100 of a single sequence indicia of the winner's choice is exchanged between the winning and losing player's decks;
- An extinction method. In "extinction" the deck of the loser has a game element 100 removed without an exchange.
  - A forced extinction sub method. In "forced extinction" this creates a deck without a fully contiguous sequence of indicia and a deck that does not meet the predefined size of the designer. Such a deck may no longer be used in standard play and is thus "extinct"; and
  - A planned extinction sub method. In "planned extinction" the designer may choose to terminate a game element 100 or sequence of game elements 100 in the deck of the loser thus rendering the deck no longer able to be used in standard play and "extinct". This extinction occurs during interaction with a game journal or database.

FIGS. 1A and 1B show that the indicia 102 can include a cost indicia 102*a*. The cost indicia 102*a* gives the cost of putting a card into play. I.e., the cost of drawing a card is predetermined with the cost given in the cost indicia 102*a*. In particular, the cost indicia 102*a* is used with the randomizing element 100 or the state of game tokens in play to govern putting a game element 100 into play or removing it from play. FIGS. 1A and 1B also show that the indicia 102 can include a sequence indicia 102*b*. The sequence indicia 102*b* is used to identify a specific element 100 within a grouping or partition of game elements 100 with an identical signature indicia called a signature partition.

FIGS. 1A and 1B further show that the indicia 102 can include a sub group indicia 102*c*. The sub group indicia 102*c* is used to group or partition a set of game elements 100 into certain types based on shared attributes including strengths, weakness and capabilities. FIGS. 1A and 1B additionally show that the indicia 102 can include an alignment indicia 102*d*. The alignment indicia 102*d* classifies a larger group or partition of game elements 100 as being part of one or more game play styles. FIGS. 1A and 1B moreover show that the indicia 102 can include a signature indicia 102*e*. The signature indicia 102*e* is used as the primary way to group or partition game elements 100.

FIGS. 1A and 1B also show that the indicia 102 can include a title 102*f*. The title 102*f* is used as the name for a game element 100. FIGS. 1A and 1B further show that the indicia 102 can include control text 102*g*. The control text 102*g* is used to explain the power or effect of a game element 100. FIGS. 1A and 1B additionally show that the indicia 102 can include a control image 102*h*. The control image 102*h* is a graphic used to represent the game element 100. This graphic may also be used as indicator of the revision level or rarity of this game element 100.

The number of game elements 100 is to be a set of a predetermined number of game elements 100 (either digital of physical) from the set of all possible game elements 100; the number is predetermined by the designer's game rules. This required set of game elements 100 (either digital of physical) is referred to a deck. Each deck must have a set of game elements 100 with unique sequence indicia 102*b*.

The game elements 100 may be made of preprinted card stock for a physical implementation. For a digital implementation the game elements 100 may be data constructs that are rendered on an output device for presentation of information in visual or tactile form such as a monitor, stereoscopic display or holographic projection.

Figure 2:
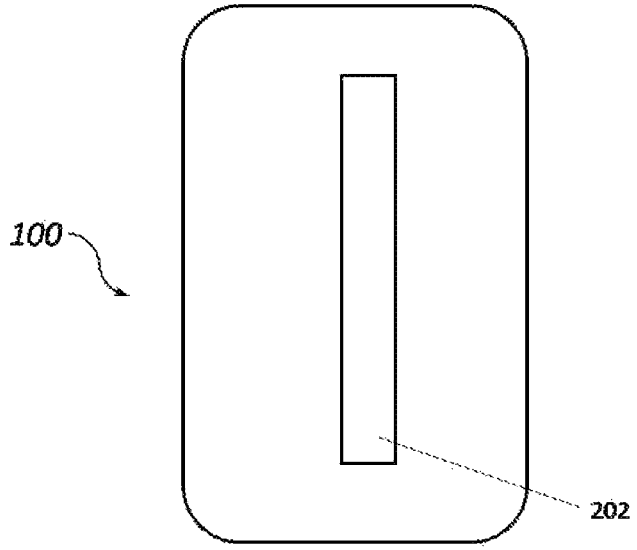
FIG. 2 illustrates a game element with a deck identifier.

FIG. 2 illustrates a game element 100 with a deck identifier 202. The deck identifier 202 uniquely identifies a collection or assembly of game elements 100 or a deck of cards. The deck identifier 202 is used with a journal or database to track transactions between collections of game elements 100. The deck identifier enables a synchronization method, reanimation method, cloning method and a fading method.

- In a synchronization method after the selection right has been exercised, "synchronization" can occur. Synchronization is the process where game results for each deck identifier 202 in play are entered into a journal or database. These results allow the deck identifier to mirror the "real" deck.
- In a reanimation method for an extinct deck identifier 202, the designer may allow the "reanimation" of a deck previously marked extinct in a journal or database by allowing a plurality of deck identifiers 202 to be merged under a previous extinct deck identifier 202. The extinct game elements 100 each have a game specific predetermined threshold for being successfully merged into the new collection of game elements 100. A randomizing element 100 determines the success of each extinct element 100 being successfully transferred to the reanimated deck. Duplicate sequence indicia elements 100 after the merge are eliminated.
- In a cloning method because the genetic deck game method of play relies on a deck identifier 202, in situations where a physical set of cards is lost or destroyed the journal or database record can provide a clone or exact copy of a set of game elements 100 up to the most recent transaction by starting with the initial distribution of game elements 100 and processing each genetic deck transaction.

In a fading method as deck identifiers age from the date of their first journal or database entry, deck identifiers become less viable in cloning or reanimation. The fading method sets a designer defined function that decreases the ability to perform successful cloning or reanimation over time. Fading errors may produce mutations that drive the mutation method.

At least one deck identifier 202 may be bundled with a set of a predetermined number of game elements 100 (either digital of physical). The deck identifier 202 may be a pre-printed card included with the distribution of a set of game elements 100. This deck identifier 202 may be human or machine readable. The deck identifier 202 may be occluded or concealed by a removable seal to prevent unauthorized activation or use of a deck identifier 202.

Figure 3:
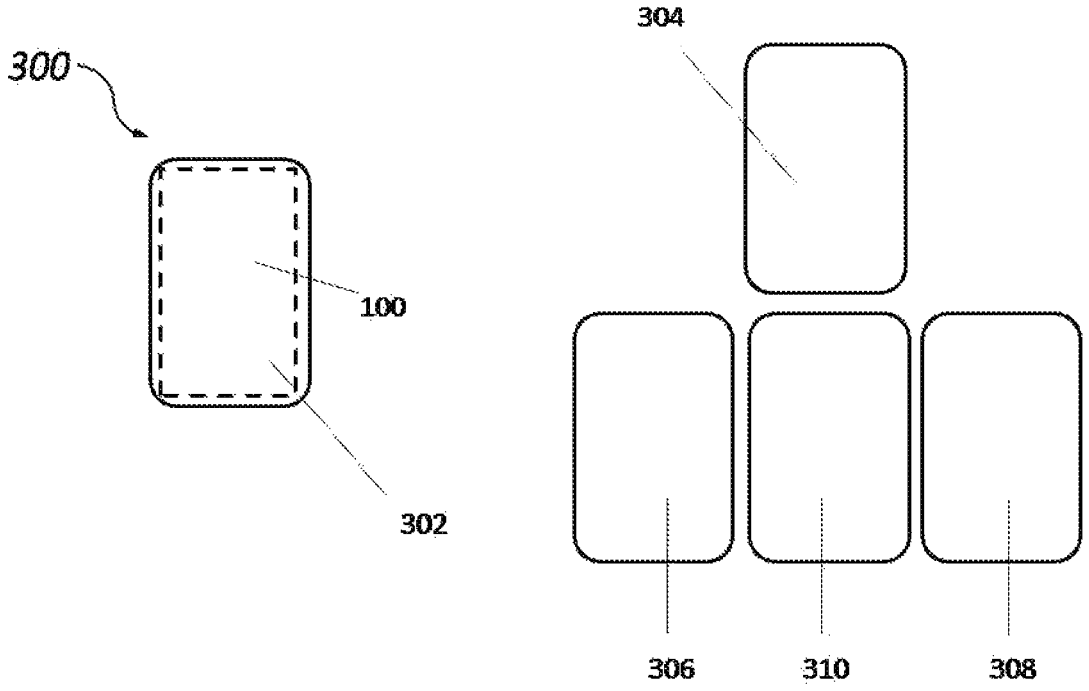
FIG. 3 illustrates the layout of game elements for a single player seating.

FIG. 3 illustrates the layout 300 of game elements 100 for a single player seating. The layout 300 can include a discard area 302, a primary activation area 304, a secondary activation area 306, a tertiary activation area 308 and a staging area 310. The primary activation area, secondary activation area and tertiary activation areas are and any additional designated activation areas are collectively referred to as the "activation area".

The discard area 302 is an area used to display or place game elements 100 removed from play, the primary activation area 304 is first of three or more areas used to display or place active game elements 100, the secondary activation area 306 is second of three or more areas used to display or place active game elements 100, the tertiary activation area 308 is third of three or more areas used to display or place active game elements 100 and the staging area 310, is the area used for elements 100 placed "face down" or otherwise partially or totally concealed waiting to be drawn into the player's hand.

The proportion and spacing of the areas 302, 304, 306, 308 and 310 are such to permit a game element 100 to fit within the described area. For digital implementations of the invention this size may be variable to fit the size of the output display. This layout 300 may be duplicated for each player in the game playing surface.

Figure 4:
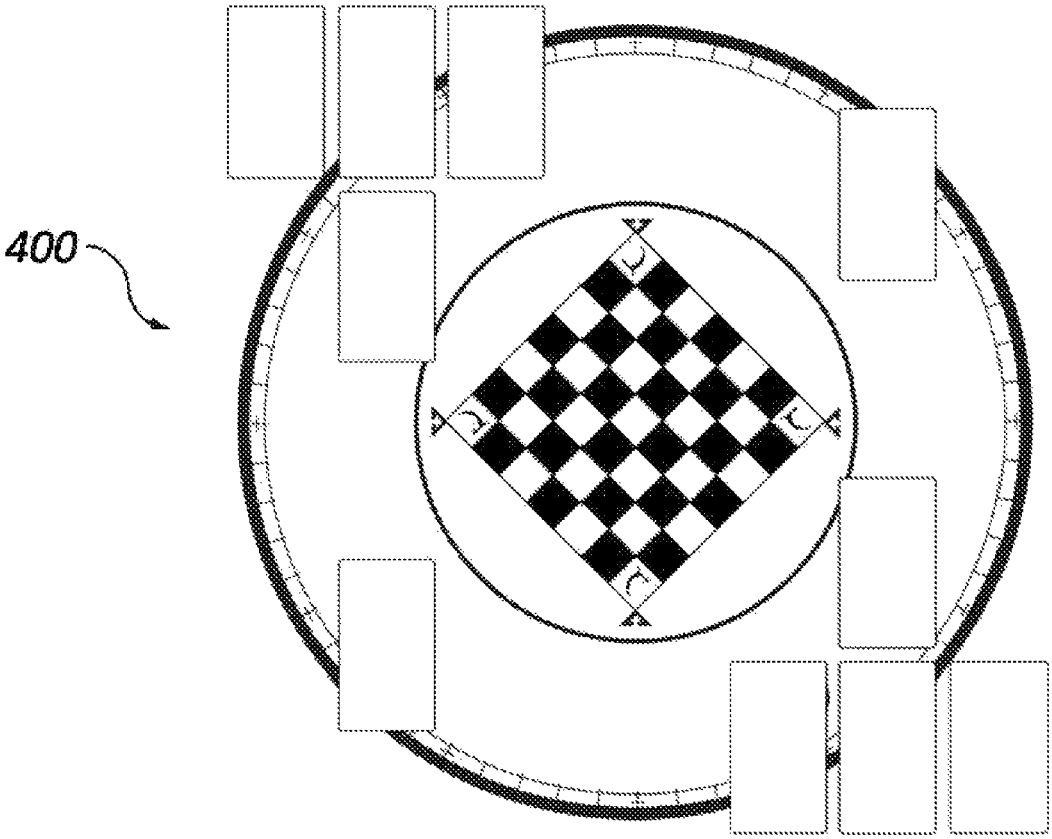
FIG. 4 illustrates a game playing surface for organizing a plurality of players participating in a genetic deck based game.

FIG. 4 illustrates a game playing surface 400 for organizing a plurality of players participating in a genetic deck based game. Areas for each additional player as described in FIG. 3 may be added. In a digital implementation these areas may exist as a plurality of screens accessed by physical or virtual control devices, pull down menus or other user interfaces. The game playing surface 400 can include a mat or board used for organizing a plurality of players participating in a genetic deck game and for playing the host or reference game that uses the genetic deck game methods.

The design of the game playing surface 400 may be customized to fit the design, theme and board requirements of the host or reference game using the genetic deck game method. The game playing surface 400 may be a physical mat or board used for organizing a plurality of players participating in a genetic deck game produced of any suitable material such paper, wood, cloth or card stock, or it may be a data construct rendered on an output device for presentation of information in visual or tactile form such as a monitor, stereoscopic display or holographic projection.

Figure 5:
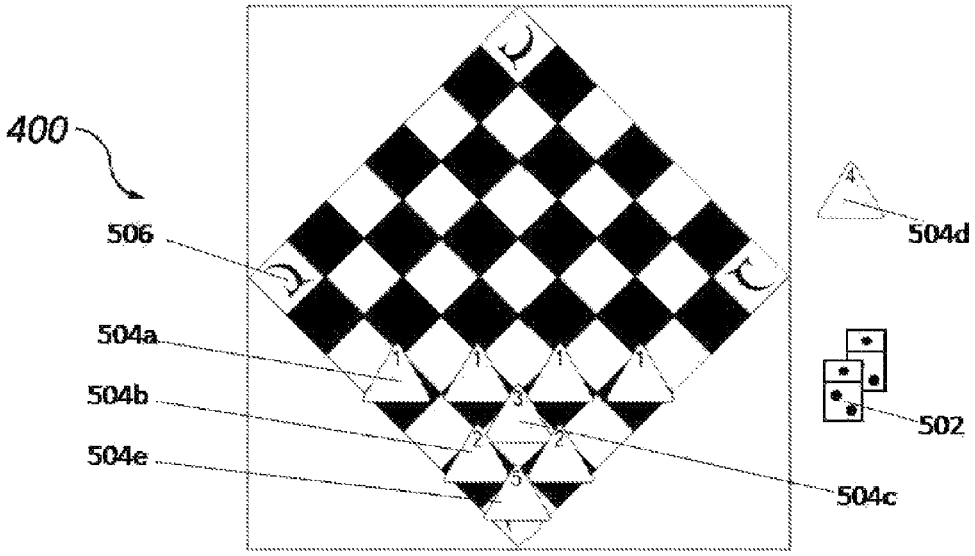
FIG. 5 illustrates an alternative game playing surface for organizing a plurality of game tokens for players participating in a game using the genetic deck method.

FIG. 5 illustrates an alternative game playing surface 400 for organizing a plurality of game tokens for players participating in a game using the genetic deck method. FIG. 5 shows that the game can include random number generators in the form of dice 502, a plurality of game tokens 504*a*-504*e* (collectively "game tokens 504") and a plurality of marked and unmarked game surface cells 506.

The game playing surface 400 is a place where a sample themed game of strategy and sorcery between at least two players is held. This game referred to as the "reference game" uses the genetic deck method disclosed. The game is over when either:

A player occupies three of the four marked game surface cells 506 on the game playing surface 400. This is called an "occupy" victory;

A player loses all of his game token 504. This is called a "vanquish" victory;

A player is unable to move or act. This is called a "bind" victory; or

A player resigns from the game. This is a called a "yield" victory.

The components needed to play the reference game may be distributed as sets for a single player or they may be distributed as sets for a multiple of players. This bundle of elements may include a set of themed genetic deck game elements with external elements such as game tokens 504 or an external game board or as a wholly integrated genetic deck with the game tokens 504 and board represented as a plurality of game elements. Game tokens 504 are each assigned a numerical value wherein:

The numerical value determines the level or strength of the playing piece;

The numerical value determines the movement range and pattern of the playing piece; and The numerical value may be adjusted during the course of play.

Each player begins with a number of tokens 504*a*-504*e*. The player begins with seven common tokens 504*a*-504*d* and one unique token 504*e*. The common tokens 504*a*-504*d* may be any design with the ability to show four or more unique states or levels. All game tokens 504 are placed on a set of starting positions on the game playing surface 400. The starting positions are mirrored by each player.

The game playing surface 400, in the form of a mat or surface in this embodiment of the invention is always arranged so that a single cell is directly in front of each player. The unique token 504*e* is placed in the cell directly in front of the player. Four common tokens 504*a* are placed on the field with a level indication of "1" in the 4th rank or horizontal row on the game playing surface 400. One common token 504*c* is placed on the field with a level indication "3" in the center cell of the 3rd rank or horizontal row on the game playing surface 400. Two common tokens 504*b* are placed on the field with a level indication "2" in the 2nd rank or horizontal row on the game playing surface 400.

Using game tokens 504 each player begins with exactly thirteen genetic deck game elements. These game elements compose the genetic deck and follow all rules for composition as described above. Before play, each player's deck of game elements is shuffled and placed "face down" in to the staging area 310 which may be marked on the game playing surface 400 (as in FIG. 5) or unmarked. Each player begins with a pair of six-sided dice. One die is designated as the random number generator affecting the game tokens. One die is designated as the random number generator affecting the genetic deck.

The random number generators 502, control the flow of the game in one embodiment by using the following rules:

The random number values from the controller of the game tokens have the following standard effects:

Value {1}: no physical move is possible this turn.

Value {3,5}: a player may move two tokens this turn.

Value {2,4,6}: a player may move one token this turn.

The values from the controller of the genetic deck have the following standard effects:

Value {1}: no casting action is possible and the player must draw or dispel one game element this turn.

Value {2-6}: a player is granted the rolled number of points to activate a card (304, 306, 308) or to draw a card from the "face down" staging area 310.

If the unique token 504*e* is removed from play, the values from the controller of the genetic deck have the following effects:

Value {1,3}: no casting action is possible and the player must draw or discard one game element this turn.

Because the battle is over when a player is unable to move or act (bind), if through a roll of the dice, a player is unable to move and has expended all of the face down cards in his "face down" staging area 310 or has no card in play 304, 306, 308 or to dispel to the discard area 302 the player loses the game.

When using the tokens 504*a*-504*e* on the game playing surface 400, player movement in the present invention is in relation to the player. Thus, "forward" and "backward" are defined in relation to the player who is currently moving. Moving away from the player is motion forward on the game playing surface 400. Moving towards the player is motion backward on the game playing surface 400. The movement tokens in this embodiment of a genetic deck based game are governed by standard methods, special methods, promotion methods and capture methods.

Under standard movement methods, generally any token 504*a*-504*e* may move as many empty cells as it has levels. For example, a token of level 4 504*d* power may move up to 4 empty cells. Additionally, no token may jump over an opponent's token or another of the player's own tokens. The unique token 504*e* may initially move 5 empty cells but is reduced in movement range for each game element in the active areas 304, 306, 308.

Under special movement methods, each token 504*a*-504*e* may move in accord with its indicated level. A level 1 504*a* token may move only 1 cell vertically forward. A level 2 504*b* token may move up to 2 cells vertically forward or backward. A level 3 504*c* token may move up to 3 cells diagonally forward. A level 4 504*d* token may move up to 4 cells diagonally forward or backward. The unique token 504*e* is considered a level 5 token and may move up to 5 cells in any direction (forward or backward diagonally, vertically or horizontally).

Under promotion movement methods, the cells located on the edge of the game board on the game playing surface 400 allow promotion. When a token 504*a*-504*d* crosses into one of these border cells the token it is promoted to a higher level. The edges are defined relative to location of the player. The two edges that are farthest from the player are the forward edges. Common tokens 504*a* and 504*c* that may move only forward are promoted when entering the cells on the forward border of the board. All other common tokens 504*b* are promoted when they enter the cells on the border closest to the player. Generally, a level 4 504*d* token may not be promoted. Generally, the unique token 504*e* may not be promoted.

Under capture methods, a token 504*a*-504*e* may capture an opponent's token by moving to an occupied cell within range. When an opponent's token is captured, the capturing token must move one additional cell horizontally or vertically from the site of the capture. This rule is referred to as the "one cell rule". Additionally a player may use "chain capturing" (chaining) to capture multiple opponent tokens by using the one cell rule to move into other cells occupied by opponent tokens.

The random number generators 502, determines which side will have the first turn of the game. Whichever side has a higher combined total moves first. Each successive turn begins with the use of a random number generator or a plurality of generators such as a set of dice. Afterwards acquiring a set of random numbers, the player may move or cast based on the numbers provided. At the end of a turn, the player announces the end of his turn. In another embodiment of the invention the state of tokens 504 remaining in play at the start of the player's turn overrides the number generated by the random number generator providing the points used to move or cast. The state of the tokens 504 in play include the individual or aggregate of any mutable variable, value or attribute of one or more active tokens 504 at an instant of time such as their current number, level, location or age.

The tokens 504, game playing surface 400 and game may be modified by the use of the genetic deck. This use of the genetic deck is called "casting" as long as the unique token is in play and there are sufficient points "to cast" or put in play a game element according to the game element's cost indicia 102*a*, the player may cast a card from their hand to the active area 304, 306, 308. Casting is governed by the following drawing methods, casting methods, limiting methods and dispelling methods.

Under drawing methods, the player begins with no cards in their hand or in play and may draw a card from his staging area 310 during his turn. The cost of drawing a card is predetermined. The cost indicia 102*a* gives the cost of putting a card into play.

Under casting methods, when a game element is put into play or "cast", the player should announce the game element or game elements being played and place the game element face up in the active area 304, 306, 308. Only a special type of game element identified as "castless" is able to be put in play with or without the unique token 504*e* being in play. The player may place a plurality of game elements in to an active area. The topmost game element governs the "stack" of cards below it and is considered the active game element in the stack.

Under limiting methods, a player may have no more than a predetermined number of game elements in hand and no more than a predetermined number of active game elements. In one embodiment of this invention the player is limited to 13 game elements in his hand and no more than 3 active game elements in play.

Under dispelling methods, when an active game element is removed from play or "dispelled", the game element is moved to the discard area 302. When the unique token 504*e* of the player is captured the player must discard all drawn game elements. The game elements in play however, remain in play until they are removed from play.

When a player wins a genetic deck based game there are three courses of action for the winner: The winner may choose not to actively use his selection rights. This act does not preclude the possibility of automatic methods such as mutation method occurring. The winner may use his selection rights to exchange game elements with the game elements from the loser's deck by using the crossover method. The winner or an official may use his selection rights to demand any single card from an opponent by using the extinction method.

The design of the game tokens 504*a*-504*e* may be customized to fit the design, theme and board requirements of the game using the genetic deck game method. The physical or virtual tokens may utilize existing polygonal objects such a dice with preprinted or inscribed indicia. In another embodiment of the invention the tokens may be a physical construct with a dial to display indicia to indicate the level of the token. In still yet another embodiment of the invention the tokens may take the form of game elements within the genetic deck as will be disclosed in FIG. 6.

The design of the game playing surface 400 may take the form of smaller board or mat omitting a plurality of preprinted areas for a single player seating as shown in FIG. 3. The part or entire game playing surface may take the form of game elements within the genetic deck as will be disclosed in FIG. 7.

The tokens 504*a*-504*e* and randomizing elements 502 may be made of plastic, stone, glass, wood or any sturdy material for a physical implementation. For a digital implementation the tokens 504 and randomizing elements may be data constructs that are rendered on an output device for presentation of information in visual or tactile form such as a monitor, stereoscopic display or holographic projection.

Figure 6:
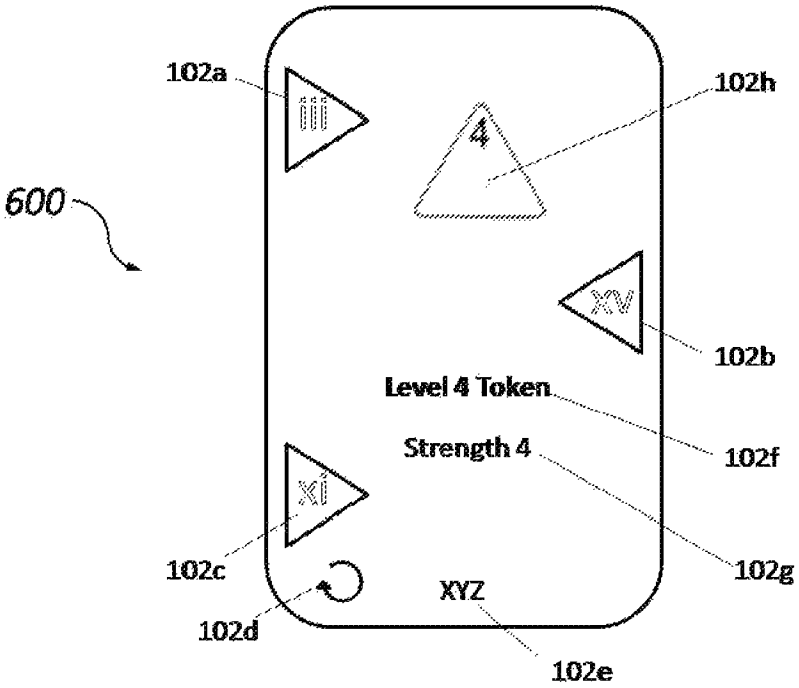
FIG. 6 illustrates an example of the tokens and playing pieces implemented as part of the collection of game elements comprising the genetic deck

FIG. 6 illustrates an example of the tokens and playing pieces implemented as part of the collection of game elements 600 comprising the genetic deck. The control image 102*h* in this alternate embodiment is a graphic used to represent the token. The token or playing piece has all of the attributes of the embodiment of FIG. 5. One game element 600 for each possible level of a token exists in the genetic deck and a higher level game element 600 must be played on top of another lower level game element 600 to promote a token. In another embodiment of the invention the levels of each token are unique for each genetic deck and players must compete for the selection right to acquire higher level tokens from other players.

The token or playing piece as part of the genetic deck has all of the other attributes of other members the genetic deck. All elements 600 of the deck should have same approximate dimensions including weight and thickness. The tokens as part of the genetic deck may be made of preprinted card stock for a physical implementation. For a digital implementation the game elements 600 may be data constructs that are rendered on an output device for presentation of information in visual or tactile form such as a monitor, stereoscopic display or holographic projection.

Figure 7:
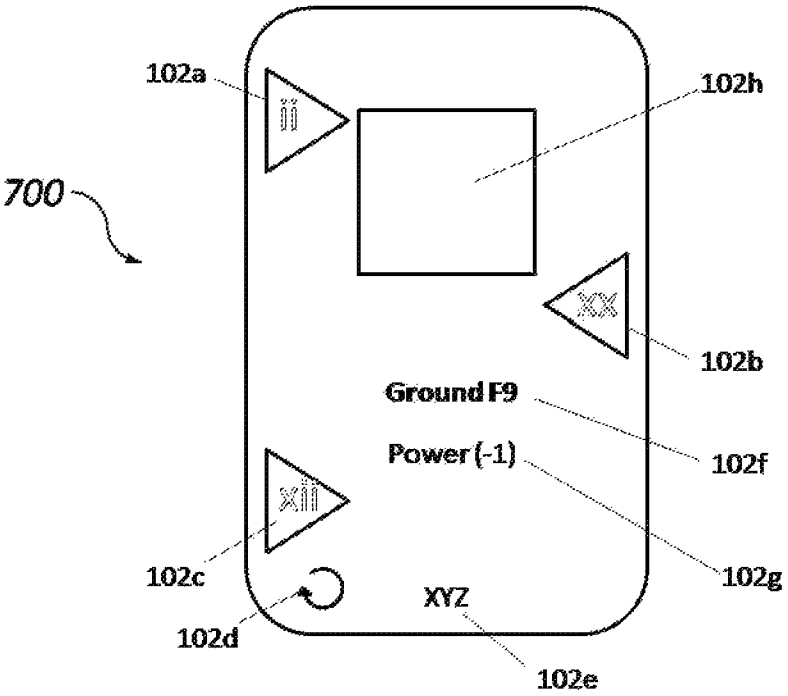
FIG. 7 illustrates an alternate example of a game element with part or the entire game playing surface implemented as part of the collection of game elements comprising the genetic deck.

FIG. 7 illustrates an alternate example of a game element 700 with part or the entire game playing surface 400 implemented as part of the collection of game elements 700 comprising the genetic deck. The control image 102*h* is a graphic used to represent the token. The control image 102*h* in is a graphic used to represent a segment of the game playing surface 400. The player may not move to areas of the game world not yet revealed by his genetic deck.

The game playing surface as part of the genetic deck has all of the other attributes of other members the genetic deck. All elements 700 of the deck should have same approximate dimensions including weight and thickness. The game playing surface as part of the genetic deck may be made of preprinted card stock for a physical implementation. For a digital implementation the game elements 700 may be data constructs that are rendered on an output device for presentation of information in visual or tactile form such as a monitor, stereoscopic display or holographic projection.

Figure 8:
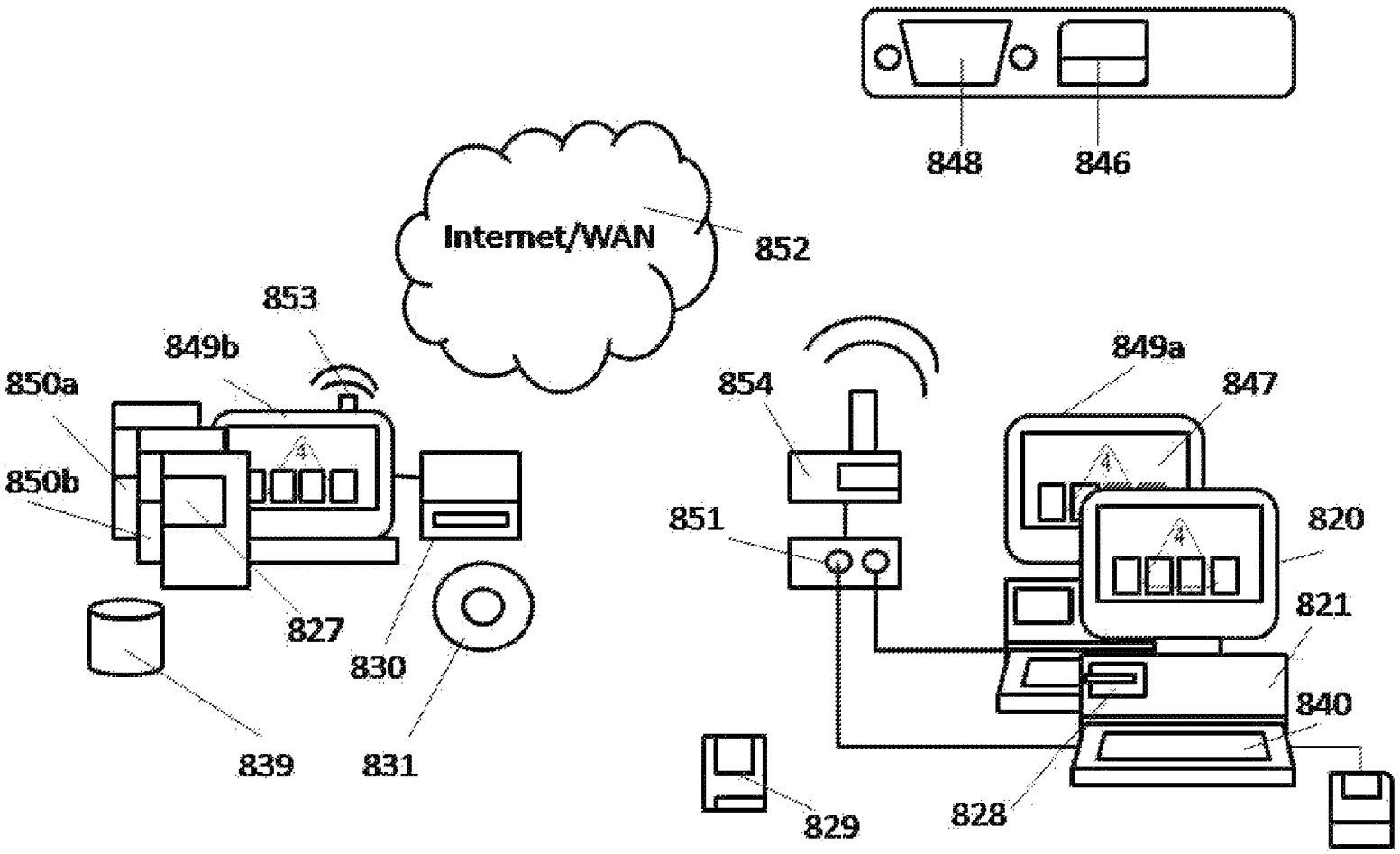
FIG. 8 illustrates an example of a suitable computing environment in which the invention may be implemented.
Figure 8:
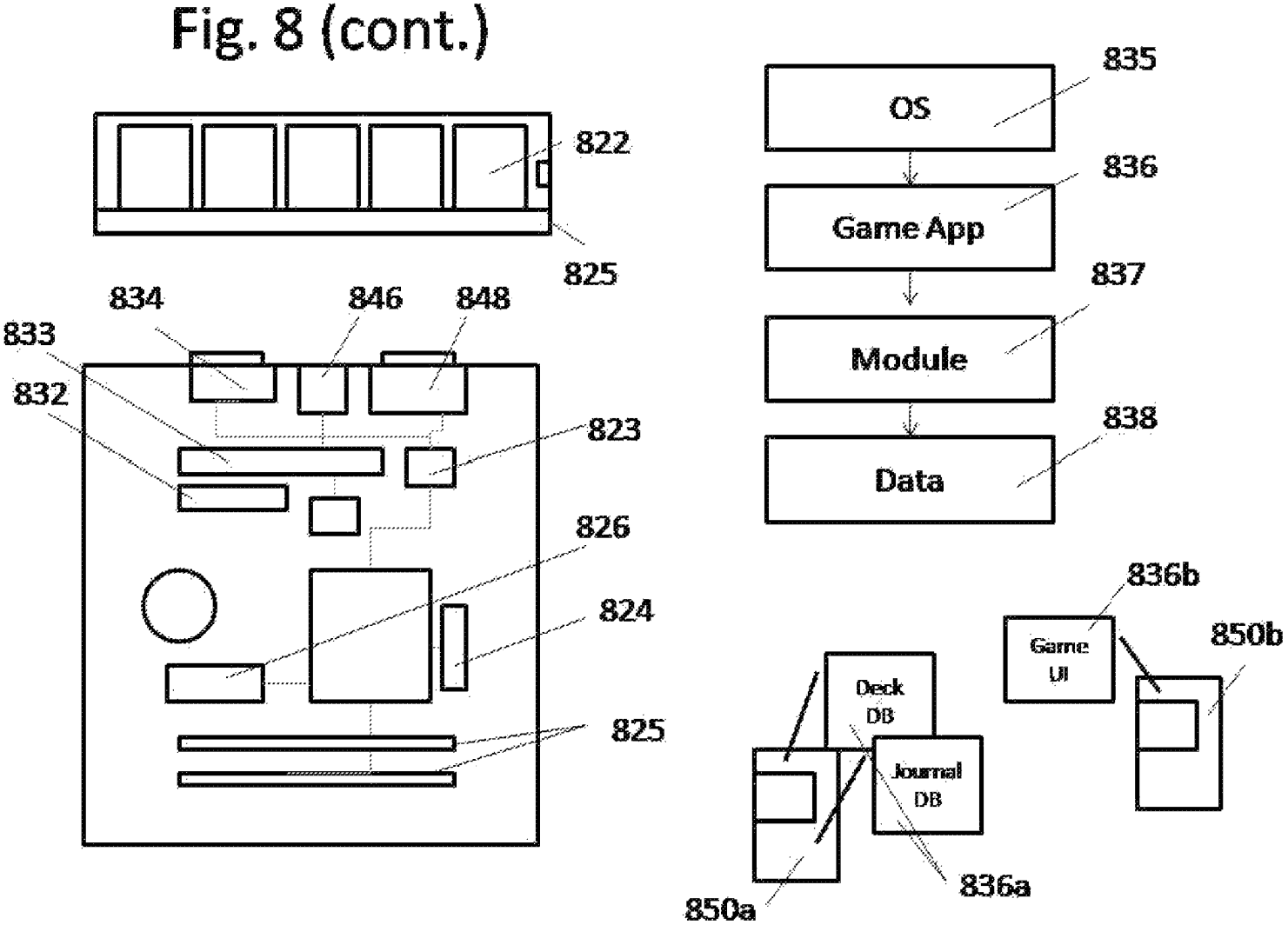

FIG. 8, and the following discussion, is intended to provide a brief, general description of a suitable computing environment in which the invention may be implemented. Although not required, the invention will be described in the general context of computer-executable instructions, such as program modules, being executed by computers in network environments. Generally, program modules include routines, programs, objects, components, data structures, etc. that performs particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

One of skill in the art will appreciate that the invention may be practiced in network computing environments with many types of computer system configurations, including personal computers, hand-held devices, mobile phones, multi-processor systems, microprocessor-based or programmable consumer electronics, network PCs, minicomputers, mainframe computers, and the like. The invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

With reference to FIG. 8, an example system for implementing the invention includes a general purpose computing device in the form of a conventional computer 820, including a processing unit 821, a system memory 822, and a system bus 823 that couples various system components including the system memory 822 to the processing unit 821. It should be noted however, that as mobile phones become more sophisticated, mobile phones are beginning to incorporate many of the components illustrated for conventional computer 820. Accordingly, with relatively minor adjustments, mostly with respect to input/output devices, the description of conventional computer 820 applies equally to mobile phones. The system bus 823 may be any of several types of bus structures including a memory bus or memory controller, a peripheral bus, and a local bus using any of a variety of bus architectures. The system memory includes read only memory (ROM) 824 and random access memory (RAM) 825. A basic input/output system (BIOS) 826, containing the basic routines that help transfer information between elements 100 within the computer 820, such as during start-up, may be stored in ROM 824.

The computer 820 may also include a magnetic hard disk drive 827 for reading from and writing to a magnetic hard disk 839, a magnetic disk drive 828 for reading from or writing to a removable magnetic disk 829, and an optical disc drive 830 for reading from or writing to removable optical disc 831 such as a CD-ROM or other optical media. The magnetic hard disk drive 827, magnetic disk drive 828, and optical disc drive 830 are connected to the system bus 823 by a hard disk drive interface 832, a magnetic disk drive-interface 833, and an optical drive interface 834, respectively. The drives and their associated computer-readable media provide nonvolatile storage of computer-executable instructions, data structures, program modules and other data for the computer 820. Although the exemplary environment described herein employs a magnetic hard disk 839, a removable magnetic disk 829 and a removable optical disc 831, other types of computer readable media for storing data can be used, including magnetic cassettes, flash memory cards, digital versatile discs, Bernoulli cartridges, RAMs, ROMs, and the like.

Program code means comprising one or more program modules may be stored on the hard disk 839, magnetic disk 829, optical disc 831, ROM 824 or RAM 825, including an operating system 835, one or more application programs 836, other program modules 837, and program data 838. A user may enter commands and information into the computer 820 through keyboard 840, pointing device 842, or other input devices (not shown), such as a microphone, joy stick, game pad, satellite dish, scanner, motion detectors or the like. These and other input devices are often connected to the processing unit 821 through a serial port interface 846 coupled to system bus 823. Alternatively, the input devices may be connected by other interfaces, such as a parallel port, a game port or a universal serial bus (USB). A monitor 847 or another display device is also connected to system bus 823 via an interface, such as video adapter 848. In addition to the monitor, personal computers typically include other peripheral output devices (not shown), such as speakers and printers.

The computer 820 may operate in a networked environment using logical connections to one or more remote computers, such as remote computers 849*a* and 849*b*. Remote computers 849*a* and 849*b* may each be another personal computer, a server, a router, a network PC, a peer device or other common network node, and typically include many or all of the elements 100 described above relative to the computer 820, although only memory storage devices 850*a* and 850*b* and their associated application programs 836*a* and 836*b* have been illustrated in FIG. 8. The logical connections depicted in FIG. 8 include a local area network (LAN) 851 and a wide area network (WAN) 852 that are presented here by way of example and not limitation. Such networking environments are commonplace in office-wide or enterprise-wide computer networks, intranets and the Internet.

When used in a LAN networking environment, the computer 820 can be connected to the local network 851 through a network interface or adapter 853. When used in a WAN networking environment, the computer 820 may include a modem 854, a wireless link, or other means for establishing communications over the wide area network 852, such as the Internet. The modem 854, which may be internal or external, is connected to the system bus 823 via the serial port interface 846. In a networked environment, program modules depicted relative to the computer 820, or portions thereof, may be stored in the remote memory storage device. It will be appreciated that the network connections shown are exemplary and other means of establishing communications over wide area network 852 may be used.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for playing a genetic deck based game, the system comprising:

a game surface including a plurality of game spaces configured to allow play by at least two players; and a first set of game tokens assigned to the first player, wherein each of the game tokens:

in the first set of game tokens is assigned a numerical value; and is configured to be placed on the game surface;

a first set of game elements assigned to the first player, wherein each of the game elements in the first set of game elements:

is configured to indicate movement of the first set of game tokens on the game surface; and includes:

one or more indicia to partition the first set of game elements into ordered subsets of game elements; and a unique identifier for the first set of game elements;

a second set of game tokens assigned to the second player, wherein each of the game tokens in the second set of game tokens:

is assigned a numerical value; and is configured to be placed on the game surface;

a second set of game elements assigned to the second player, wherein each of the game elements in the second set of game elements:

is configured to indicate movement of the first set of game tokens on the game surface; and includes:

one or more indicia to partition the second set of game elements into ordered subsets of game elements; and a unique identifier for the second set of game elements;

a layout for each of the two players for placement of the player's game elements; and a set of random number generators for affecting at least one of:

the first set of game elements; or the first set of game tokens.

2. The system of claim 1, wherein the indicia includes a cost indicia that gives the cost of putting a card into play.

3. The system of claim 1, wherein the indicia includes a sequence indicia that is used to identify a specific element within a grouping or partition of game elements with an identical signature indicia called a signature partition.

4. The system of claim 1, wherein the indicia includes a sub group indicia that is used to group or partition a set of game elements into certain types based on shared attributes including strengths, weakness and capabilities.

5. The system of claim 1, wherein the indicia includes a signature indicia configured to be used as the primary way to group or partition game elements.

6. The system of claim 1, wherein the indicia includes a title used as the name for a game element.

7. The system of claim 1, wherein the indicia includes control text configured to explain the power of a game element.

8. The system of claim 1, wherein the indicia includes a control image configured to represent the game element.

9. The system of claim 1, wherein the numerical value determines the level or strength of the game token.

10. The system of claim 1, wherein the numerical value determines the movement range and pattern of the game token.

11. The system of claim 1, wherein the numerical value may be adjusted during the course of play.

12. The system of claim 1, wherein the playing surface includes a board.

13. The system of claim 1, wherein the playing surface includes a mat.

14. The system of claim 1, wherein the random number generators include dice.

15. The system of claim 1, further comprising a journal, wherein the journal:

allows the activation of the first set of game elements using a unique identifier;

allows the de-activation of the first set of game elements using the unique identifier.

* * * * *